US005079801A

United States Patent [19]

Peterson

[11] Patent Number: 5,079,801

[45] Date of Patent: Jan. 14, 1992

[54] PROTECTION SCISSORS

[76] Inventor: Larry M. Peterson, 408 Valentina, Gallup, N. Mex. 87301

[21] Appl. No.: 605,984

[22] Filed: Oct. 29, 1990

[51] Int. Cl.[5] ..... B25F 1/00

[52] U.S. Cl. ..... 7/135; 7/158; 30/122; 30/146

[58] Field of Search ..... 7/135, 158, 170; 273/84 R; 30/232, 341, 122, 142, 123, 146, 312

[56] References Cited

U.S. PATENT DOCUMENTS

| | | | |
|---|---|---|---|
| 78,615 | 6/1968 | Spear et al. . | |
| 104,996 | 7/1970 | Frang . | |
| 154,750 | 9/1974 | Flack et al. . | |
| 1,293,122 | 2/1919 | Koehler | 30/341 |
| 1,301,753 | 4/1919 | Seniw . | |
| 1,771,031 | 4/1929 | Court . | |
| 2,353,416 | 7/1944 | Silver | 30/123 |
| 3,835,533 | 9/1974 | Granson | 30/146 |
| 4,485,507 | 12/1984 | Kantwerk | 7/135 |
| 4,528,707 | 7/1985 | Aida | 7/131 |

FOREIGN PATENT DOCUMENTS 1075008 4/1960 Fed. Rep. of Germany .

OTHER PUBLICATIONS

Advertisement for "BC-41" Fighting Knife manufactured by EK Commando Knife Company, Richmond, Va.

*Primary Examiner*—Roscoe V. Parker
*Attorney, Agent, or Firm*—Donovan F. Duggan; Deborah A. Peacock

[57] ABSTRACT

Protection scissors comprising blades with sharpened outer edges and handles functioning as brass knuckles.

5 Claims, 2 Drawing Sheets

PROTECTION SCISSORS

BACKGROUND OF THE INVENTION

1. Field of the Invention

This invention relates to a household implement possessing a defensive capability.

2. Background Art

The burgeoning increase of crime in today's society continues apace. Assaults upon the person have dramatically increased in recent years. Due to this increase in crime, police can no longer be relied upon to respond in a timely manner; self-defense has taken on an importance unknown in previous years.

Of particular concern are the increased number of assaults. Accordingly, some convenient portable means of defense becomes especially desirable in this regard.

Most jurisdictions, however, have laws or ordinances strictly regulating the carrying of concealed weapons. Firearms, especially, have drawn law enforcement and legislative attention. Knives greater than a specified length are also proscribed; similarly with tear gas dispensers, "stun guns", and the like.

Spear, et. al U.S. Pat. No. 78,615, entitled Pruning Implement discloses pruning shears in which the back of the blade is also edged. Prang U.S. Pat. No. 104,996, entitled Shears teaches library shears having a sharpened back edge serving as a paper knife. Flack U.S. Pat. No. 154,750, entitled Combined Scissors and Knives discloses a combination knife and scissors wherein the blades may be closed in a manner similar to knife blades, and may be opened and used as a knife or scissors. Seniw U.S. Pat. No. 1,301,753, entitled Bayonet discloses a combination bayonet and shear suitable for cutting barbed wire. Court U.S. Pat. No. 1,771,031, entitled Combination Knife and Scissors discloses scissors wherein the blade of the scissors is a table knife. Granson U.S. Pat. No. 3,835,533, entitled Combination Knife and Shear teaches two blades that may be interlocked in one position to form a knife or joined by a pivot to form scissors.

German Patent 1,075,008 discloses dagger-type scissors having spring-loaded pivotal arms attached to the handles. Aida U.S. Pat. No. 4,528,707, entitled Combination Scissors and Paper Knife, teaches a combination scissors and paper knife.

None of these references teach a simple, legal, convenient implement combining the functions of weapon and utensil. The existing prior art simply does not address the problem, and hence offers no pertinent solution.

SUMMARY OF THE INVENTION

The present invention comprises a combination weapon and household implement comprising a pair of blades pivotable about a central axis. The blades comprise handle portions and edged portions, the edged portions comprising sharpened edges on each side of the edged portions. The handle portion comprise brass knuckles. The edged portion and handle portion lie along a common plane. The blades comprise scissors; when closed, the blades comprise a dagger. The brass knuckles comprise a finger guard. The finger guard may be made of a material of the same or greater density than the blades. The material comprising the finger guard may be made of a material selected from the group consisting of lead, lead alloys, stainless steel, carbon steel, brass, and bronze. The finger guard is encapsulated with a cushioning material selected from the group consisting of plastic, rubber, nylon, and fabric.

The invention further comprises a combination tool comprising a pair of blades, each blade comprising sharpened edges on each side of the blade. Each pair of blades function as scissors and dagger.

The invention also comprises a combination tool comprising a pair of scissors comprising blades having sharpened outer edges and handles comprising metal of the same or greater density than said blades. When closed, the blades and handles lie along a common plane.

The invention further comprises a combination weapon and household implement comprising blades pivotable about a central axis. The blades comprise a handle portion and an edged portion. The edged portion comprises sharpened edges on each side, and the handle portion comprises a finger guard of the same or greater density than the edged portion. The handle portion comprises metal selected from the group consisting of lead, lead alloys, stainless steel, carbon steel, brass, and bronze. The blades and the handle portion lie along a common plane when closed.

An object of the invention is to provide a combination weapon and utensil which is easily portable.

Another object of the invention is the provision of a tool combining the function of knife, scissors, brass knuckles, and letter opener.

One advantage of the invention is that is may be legal to carry about the person.

Another advantage of the invention is its simplicity, ease of manufacture, and low cost.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustration a preferred embodiment of the invention and are not to be construed as limiting the invention.

DESCRIPTION OF THE PREFERRED EMBODIMENT

Figure 1:
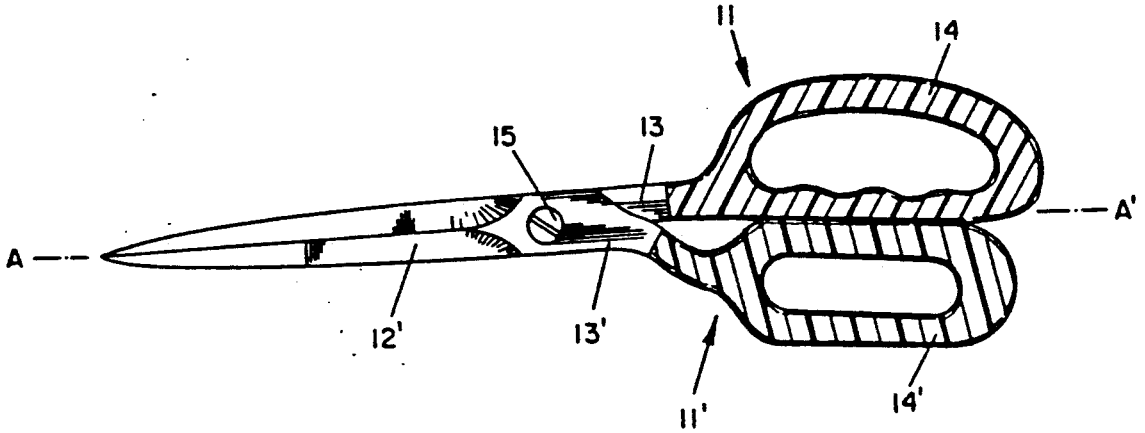
FIG. 1 is a side view of the preferred embodiment of the invention.
Figure 2:
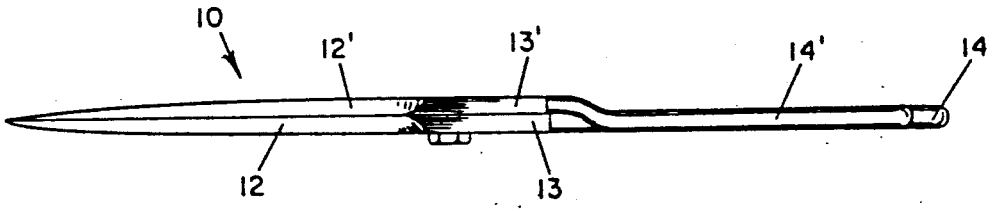
FIG. 2 is a top view of the preferred embodiment of the invention.

Reference is made to FIGS. 1-5 which show the preferred embodiment of the invention. As illustrated therein, protection scissors 10 comprises a pair of blades 11, 11'. Each blade 11,11' comprises handle portions 14,14', central pivotable portions 13,13', and blade portions 12,12'.

Handle portions 14,14' comprise grips and finger guards to assist in cutting and to protect the user's hand. In a defensive mode, however, handle portions 14,14' serve as brass knuckles. Toward this end, handle portions 14,14' may comprise various metals and alloys of the same, or greater density than blade portions 12,12'. Suitable materials for handle portions 14,14' comprise lead, lead alloys, stainless steel, carbon steel, brass, bronze, and the like. Handle portions 14,14' are encapsulated or coated to further protect the user's hand. Such coating or encapsulation, however, is not of sufficient thickness to unduly dampen or cushion can intended blow with handle portions 14,14'. Suitable coating materials for such coatings include plastic, rubber, nylon and fabric.

Each blade 11,11' also comprises central pivotable portions 13,13'. When joined by pivot 15, which may comprise a pivot pin, nut and bolt, rivet, or the like, blades 11,11' open and close as conventional scissors or shears. Closed, blades 11,11' may function as a dagger or poniard.

Each blade 11,11' further comprises blade portions 12,12'. With specific reference to FIGS. 4 and 5, each blade portion 12,12' further comprises edges 17,17' and 16,16', respectively. Edges 17,17' and 16,16', are formed by beveling and sharpening blade portions 12,12' on each side thereof, resulting in sharpened edges on each side of blade portions 12,12'. Edges 16 and 17 used together comprise conventional shears or scissors. When blades 11,11' are closed, edges 16' and 17' together comprise a double-edged dagger or poniard.

Figure 5:
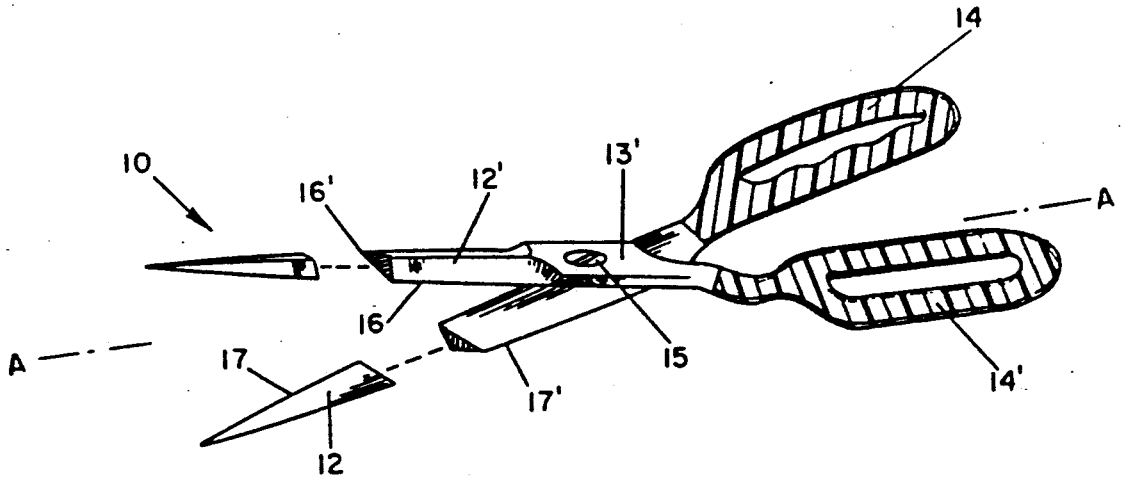
FIG. 5 is a perspective view of the preferred embodiment of the invention partially opened, and showing a cutaway of the scissor blades.

As best depicted in FIG. 5, beveling and sharpening blade portions 12,12' results in blade portions 12,12' assuming a triangular configuration in cross-section. Apices of these triangular blade cross-section are outboard of blade portions 12,12', and such apices, when blade portions 12,12' are closed, lie in common plane A,A'.

Figure 3:
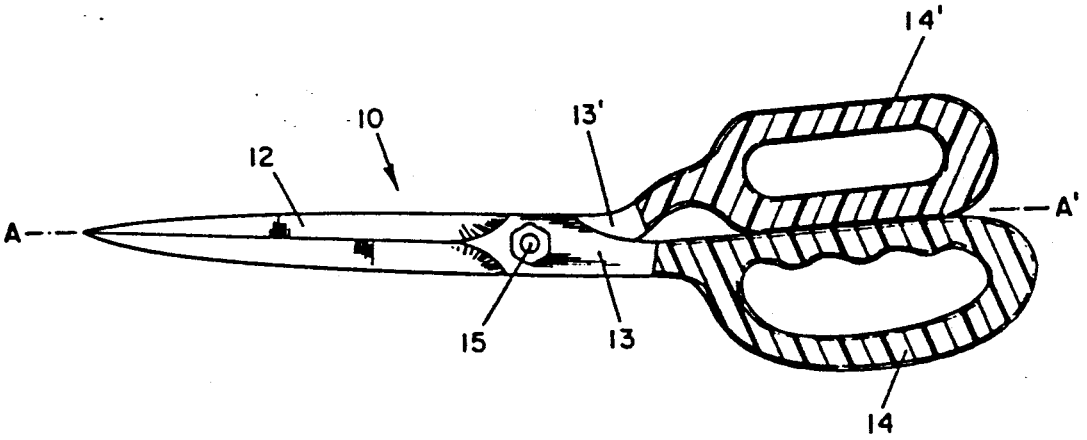
FIG. 3 is an alternative side view of the preferred embodiment of the invention.
Figure 4:
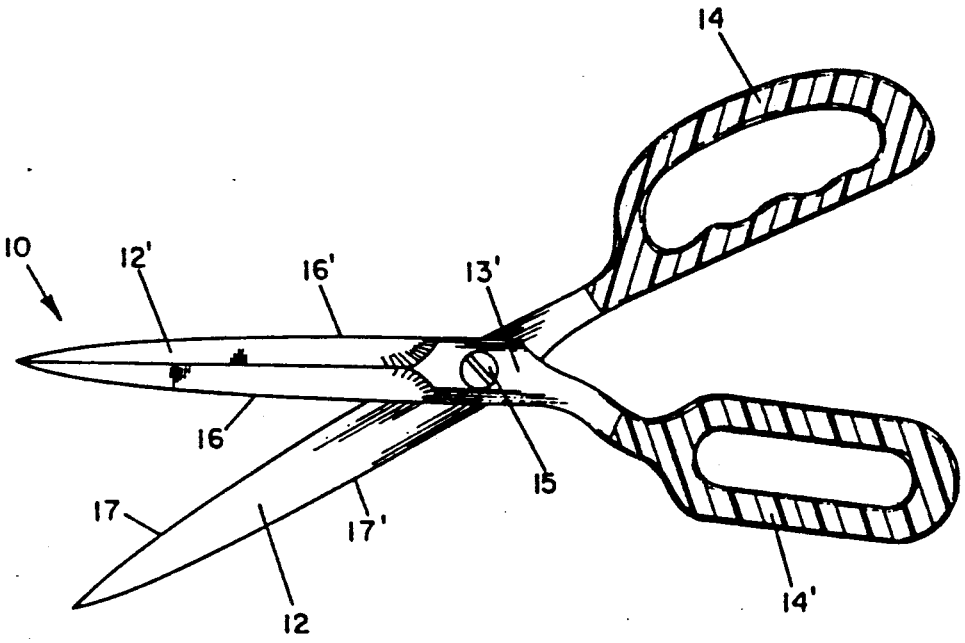
FIG. 4 is a side view of the preferred embodiment of the invention partially opened.

With further reference to FIGS. 1 and 3, handle portions 14,14 also substantially meet along common plane A,A' when blade portions 12,12' are closed.

The advantages accruing to such planar alignment of blade portions and handle portions are two-fold: with the handle portions meeting along a plane, a user's hand more easily finds purchase to grip the implement for stabbing or thrusting use; and, when so stabbing or thrusting, force is exerted vectorily and linearly along the plane without force components being diverted along other, less effective vectors. Both advantages contribute to ease of use and efficiency of the protection scissors when used in a defensive mode.

Protection scissors 10 may be unobtrusively carried in a sewing basket, purse, or pack and perform a scissors function, as intended. However, if required, protection scissors may be used in a defensive mode, presenting the dual defensive capability of dagger and brass knuckles.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A combination weapon and household implement comprising:

a pair of blade means comprising scissors means pivotable about a central axis and, when closed, dagger means;

said pair of blade means comprising handle portions and edged portions, which, when closed, lie along a common plane;

said edged portions comprising sharpened edges on each side of said edged portions;

said handle portions permitting four fingers of a handle to pass therethrough and comprising brass knuckle means and a cushioning material; and one of said handle portions comprising a plurality of interior protrusions spaced so as to permit fingers to lie therebetween.

2. The invention of claim 1 wherein said brass knuckle means is made of a material having a same density as said edged portions.

3. The invention of claim 1 wherein said brass knuckle means is made of a material having a greater density than said edged portions.

4. The invention of claim 1 wherein said brass knuckle means is made of a material selected from the group consisting of lead, lead alloys, stainless steel, carbon steel, brass, and bronze.

5. The invention of claim 1 wherein said cushioning material is selected from the group consisting of plastic, rubber, nylon, and fabric.

* * * * *